United States Patent [19]

Wixon

[11] 4,416,811

[45] * Nov. 22, 1983

[54] DETERGENT SOFTENER COMPOSITIONS

[75] Inventor: Harold E. Wixon, New Brunswick, N.J.

[73] Assignee: Colgate-Palmolive Company, New York, N.Y.

[ * ] Notice: The portion of the term of this patent subsequent to Oct. 28, 1997 has been disclaimed.

[21] Appl. No.: 288,921

[22] Filed: Jul. 31, 1981

Related U.S. Application Data

[63] Continuation of Ser. No. 96,370, Nov. 21, 1979, Pat. No. 4,298,480, which is a continuation-in-part of Ser. No. 968,532, Dec. 11, 1978, Pat. No. 4,230,590.

[51] Int. Cl.[3] ..... C11D 1/86; C11D 10/04; C11D 17/06; D06M 13/48

[52] U.S. Cl. ..... 252/8.75; 252/117; 252/134

[58] Field of Search ..... 252/8.75, 8.8, 92, 95, 252/98, 110, 117, 131, 135, 140, 174.25, 528, 547

[56] References Cited

U.S. PATENT DOCUMENTS

| | | | |
|---|---|---|---|
| 3,325,404 | 6/1967 | Cohen | 252/8.75 |
| 3,325,414 | 6/1967 | Inamorato | 252/110 |
| 3,576,748 | 4/1971 | Peterson | 252/110 |
| 3,852,211 | 12/1974 | Ohren | 252/110 |
| 3,920,563 | 11/1975 | Wixon | 252/8.75 |
| 3,936,537 | 2/1976 | Baskerville | 427/242 |
| 3,954,632 | 5/1976 | Gloss | 252/8.8 |
| 4,082,682 | 4/1978 | Inamorato | 252/92 |
| 4,178,255 | 12/1979 | Stima | 252/8.8 |
| 4,183,815 | 1/1980 | Wixon et al. | 252/8.8 |
| 4,230,590 | 10/1980 | Wixon | 252/97 |
| 4,298,480 | 11/1981 | Wixon | 252/8.75 |
| 4,308,151 | 12/1981 | Cambre | 252/8.8 |
| 4,329,237 | 5/1982 | Wixon | 252/8.75 |

*Primary Examiner*—Dennis L. Albrecht

[57] ABSTRACT

Heavy duty detergent compositions, particularly for imparting improved softness and detersive effects to fabrics laundered therewith, said composition including in addition to conventional builder and principally anionic surfactant components, fatty acid soap, and cationic softener of the di-lower-di-higher alkyl quaternary ammonium and/or hetrocyclic imide type, e.g., imidazolinium, the weight ratio of soap to softener being about 8:1 to 1:3 preferably 5:1 to 1:2, more preferably 3:2:2:3, e.g. about unity. The soap in the form of a spaghetti, flake, or other shape and is present in the product composition as substantially homogeneously dispersed, discrete particles.

23 Claims, No Drawings

DETERGENT SOFTENER COMPOSITIONS

This is a continuation of application Ser. No. 96,370 filed Nov. 21, 1979, U.S. Pat. No. 4,298,480 which is in turn a continuation-in-part of Ser. No. 968,532, filed Dec. 11, 1978, U.S. Pat. No. 4,230,590.

FIELD OF THE INVENTION

This invention relates to detergent compositions and in particular to detergent-softener compositions capable of imparting improved softness, detersive effects, soil antiredeposition and antistatic properties to fabrics treated therewith and particularly in a machine laundering process.

BACKGROUND OF THE INVENTION

Discussion of the Prior Art

Compositions for simultaneously achieving detergency and an appreciable level of softness in the machine laundering of fabrics, and thus suitable for use in the wash cycle, are well-known and widely available commercially. The fugitive interaction between anionic surfactant, perhaps the most commonly used of the available types of surfactants, and cationic softeners, particularly those of the di-lower-di-higher alkyl quaternary ammonium type, is likewise well recognized in the patent literature. Such interaction often results in the formation of unsightly precipitates which become entrapped within or otherwise deposit upon the fabric being washed. Discoloration or other aesthetically displeasing effects are for the most part inevitable. The net result is often a depletion in the effective amount of anionic available for useful purposes since the loss of anionic is the primary consequence.

Remedial techniques heretofore proposed to abate the aforedescribed cationic-anionic problem though divergent as to approach seem convergent as to result namely, less than satisfactory. Thus, although the most effective types of cationic quaternary ammonium softeners, as exemplified by the afore-mentioned di-higher alkyl type quats, such as distearyl dimethyl ammonium chloride, can function in the wash cycle in the presence of anionic, builder, etc., the quantity needed to achieve effective softening is usually coterminous with amounts promotive of undesired cationic-anionic interaction. As a general rule, at least about twice as much cationic is required for softening as for antistat.

In U.S. Pat. No. 3,325,414, dealing primarily with detergents of controlled foam or sudsing capability, the cationic-anionic problem and attendant detrimental effects are discussed in detail. The patent additionally points out that certain quaternary ammonium compounds, among the class of cationic agents, are generally unstable when heated and when in contact with alkaline builders, the instability being manufactured by the development of strong amine odors and undesirable color. The compositions of the patent are limited to the use of quaternary ammonium halides having but one higher alkyl group, the given structural formula for the cationic being correspondingly limited. Cationics of this type are markedly inferior to the di-higher alkyl types at least insofar as fabric softening activity is concerned.

Other prior art teachings at least tacticly avoid the use of cationic softeners altogether proposing the use of, for example, anionic materials as softening agents. U.S. Pat. No. 3,676,338 is representative, this patent teaching the use of anionic softener referred to as "branched-chain carboxylic acids", as fabric softener. Presumably, anionic detergent would be stable in the presence of the anionic softener.

As the foregoing demonstrates, the remedies proposed necessitate the discarding of softeners and principally those of the di-higher-di-lower alkyl quaternary ammonium salt and cyclic imide types, these having been determined by experience to be among the most effective softeners thus far developed in the art.

Thus, a primary object of the present invention is to provide detergent softener compositions wherein the foregoing and related disadvantages are eliminated or at least substantially mitigated.

Another object of the present invention is to provide detergent softener compositions capable of imparting improved softness and detersive effects to fabrics treated therewith in the wash cycle of a laundering process.

Yet another object of the invention is to provide such compositions wherein the overall functionality and particularly the softening capability of cationic amine softeners of the relatively high softening type such as typified by the di-higher-di-lower alkyl quaternary ammonium salts and cyclic imides is optimized both as to effect and concentration.

Still another object of the invention is to provide such compositions wherein the concentration of high softening type cationics can be increased substantially to achieve a wide variety of beneficial effects in terms of softening, detergency, antistat and antiredeposition properties and the like despite the presence of anionic surfactant.

A further object of the invention is to provide such compositions wherein problems associated with softener instability in the presence of alkaline builder salts as well as other components of heavy duty detergent formulations are ameliorated.

Yet a further object of the invention is to provide such compositions wherein the water solubility and/or dispersibility of cellulose ether type antiredeposition agents may be materially enhanced.

A still further object of the invention is to provide such compositions wherein the aforementioned improvements are realized whether the builder salt be of the phosphate or non-phosphate type.

Other objects and advantages of the invention will become more apparent hereinafter as the description proceeds.

The foregoing objects are attained in accordance with the invention which in its broader aspects include the provision of stable detergent softener compositions capable of providing improved softness, detergency, antistatic and soil anti redoposition properties to fabrics treated there with in a laundering process comprising by weight from about 5 to 40% preferably 9 to 40% and most preferably 9 to 30% of water soluble, non-soap, organic surfactant at least about 90% thereof being of the anionic type, from about 10 to 60% of water soluble, neutral to alkaline builder salt, from about 2 to 20% water soluble or dispersible fatty acid soap in spaghetti-like or other shaped, discrete form, from about 2 to 20% of cationic softner selected from (a) aliphatic, di-(lower) $C_1$ to $C_4$ alkyl, di-(higher) $C_{14}$–$C_{24}$ alkyl quaternary ammonium salts, (b) heterocyclic compounds, and mixtures of (a) and (b), the weight ratio of soap to softener being from about 2:3 to 3:2, the percent concentration of anionic surfactant being at least about $1.5x+5$, x representing the percent concentration of softener, wherein the soap is substantially homogeneously dispersed in said composition preferably as discrete particles.

In certain other aspects, the invention includes both the processes of formulating and using the aforedescribed compositions.

Of primary importance in the present invention is the conjoint use of the fatty acid soap component and the quaternary softener within the parameters given. As previously mentioned, the obtention of truly effective fabric softening with cationic softener, anionic detergent-based compositions required high concentration levels of softener, this being to the detriment of detergency, i.e., cleaning or whitening. Thus, increased cationic concentration though providing some improvement in softness, nevertheless leads to a visually discernible loss in fabric whitening due to cationic-anionic interaction, the latter being particularly acute with high softening cationic of di-higher-di-lower alkyl quaternary ammonium salt and/or heterocyclic imide types.

Surprisingly, it is found in the present invention that the use of approximately equal quantities of cationic and soap or within a 2:3 to 3:2 mutual weight ratio thereof, leads to significantly enhanced improvement in fabric softening despite the use of relatively low softener concentrations. Moreover, increase of the softener concentration well beyond the limits previously imposed due to cationic-anionic interaction has minimal adverse effect on cleaning and whitening and produces yet greater softening effects. Without intending to be bound by theory, it appears that the soap significantly enhances the softness of low cationic concentrations, which are at least adequate for antistat, without adversely affecting cleaning and whitening.

As will be understood, the softening capabilities of individual components are not additive when combined and in fact the cumulative effect may well be a net softness value less than that assigned for the most effective softening agent present in the combination. Thus, a plurality of poor softeners will most likely provide an equally poor net softening result. Softness is usually measured on a scale of 1 to 10 the higher values connoting increased softness.

If one were to combine equally a softener having a scale softness rating of 8, corresponding to moderate or effective softening, with a softener having a rating of 2, indicative of inferior softening, the net combined softening effect would not be additive to give a scale rating of 10, indicative of excellent softness. More than likely, the resultant softening rating would lie somewhere between the aforementioned 8 and 2 ratings indicating their respective softening effects to be mutually subtractive rather than additive. In this context, it is indeed surprising to find that the soap component herein, a material not having significant softening capabilities, actually improves, substantially, the softening effects of high softening cationics to the extent that cationic softener concentration normally considered to be effective for antistat purposes only, are likewise effective for producing excellent softening. In addition, the absence of any deleterious effects upon the detersive function of the anionic component with increased concentration of cationic enables the attainment of even greater softening effects, most notable here being the quality of fluffiness. This in turn correspondingly maximizes the antistat function of the cationic softener and particularly as regards di-higher-di-lower alkyl quaternary ammonium salts.

Fatty acid soaps useful herein include generally those derived from natural or synthetic fatty acids having from 10 to 30 carbons in the alkyl chain. Preferred are the alkali metal, e.g. sodium and/or potassium soaps of $C_{10}$–$C_{24}$ saturated fatty acids, a particularly preferred class being the sodium and/or potassium salts of fatty acid mixtures derived from coconut oil and tallow, e.g. the combination of sodium coconut soap and potassium tallow soap in the mutual proportions respectively of 15/85. As is known, as the molecular weight of the fatty acid is increased, the more pronounced becomes its foam inhibiting capacity. Thus, fatty acid selection herein can be made having reference to the foam level desired with the product composition. In general, effective results obtain wherein at least about 50% of the fatty acid soap is of the $C_{10}$-$C_{18}$ variety. Other fatty acid soaps useful herein include those derived from oils of palm groundnut, hardened fish, e.g. cod liver and shark, seal, perilla, linseed, candlenut, hempseed, walnut, poppyseed, sunflower, maize, rapeseed, mustardseed, apricot kernel, almond, castor and olive, etc. Other fatty acid soaps include those derived from the following acids: oleic, linoleic, palmitoleic, palmitic linolenic, rincinoleic, capric myristic and the like, other useful combinations thereof including, without necessary limitation, 80/20 capric-lauric, 80/20 capric myristic, 50/50 oleic-capric, 90/10 capric-palmitic and the like.

Cationic softeners useful herein are known materials and are of the high-softening type. Included are the $N_1$N-di-(higher) $C_{14}$–$C_{24}$, $N_1$N-di(lower) $C_1$–$C_4$ alkyl quaternary ammonium salts with water solubilizing anions such as halide, e.g. chloride, bromide and iodide; sulfate, methosulfate and the like and the heterocyclic imides such as the imidazolinium.

For convenience, the aliphatic quaternary ammonium salts may be structurally defined as follows:

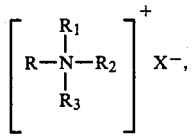

wherein R and $R_1$ represent alkyl of 14 to 24 and preferably 14 to 22 carbon atoms; $R_2$ and $R_3$ represent lower alkyl of 1 to 4 and preferably 1 to 3 carbon atoms, X represents an anion capable of imparting water solubility or dispersibility including the aforementioned chloride, bromide, iodide, sulfate and methosulfate. Particularly preferred species of aliphatic quats include:

distearyl dimethylammonium chloride
di-hydrogenated tallow dimethyl ammonium chloride
di tallow dimethyl ammonium chloride
distearyl dimethyl ammonium methyl sulfate
di-hydrogenated tallow dimethyl ammonium methyl sulfate.

Heterocyclic imide softeners of the imidazolinium type may also, for convenience, be structurally defined as follows:

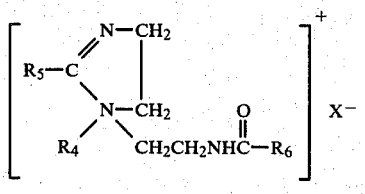

wherein $R_4$ is lower alkyl of 1 to 4 and preferably 1 to 3 carbons; $R_5$ and $R_6$ are each substantially linear higher alkyl groups of about 13 to 23 and preferably 13 to 19 carbons and X has the aforedefined significance. Particularly preferred species of imidazoliniums include:

methyl-1-tallow amido ethyl-2-tallow imidazolinium methyl sulfate; available commercially from Sherex Chemical Co. under the tradename Varisoft ®475 as a liquid, 75% active ingredient in isopropanol solvent;

methyl-1-oleyl amido ethyl-2-oleyl imidazolinium methyl sulfate; available commercially from Sherex Chemical Co. under the tradename Varisoft ®3690, 75% active ingredient in isopropanol solvent The concentration of soap and softener is from about 2 to 20% each based on the product detergent composition. For best results, the weight ratio of soap-softener is from about 2:3 to 3:2 with values approximating unity being particularly preferred. Departures from the aforestated range are not recommended since loss of softener and/or detersive effects may be severe.

The soap as used herein is produced in suitable forms in any of many conventional techniques, e.g. pelleting, granulation, stamping and pressing. Working may be effected, for example, by roll milling, although this is not essentially followed by extrusion in a conventional soap plodder with the desired type of extrusion head. The latter is selected in accordance with the shape, i.e. geometric form, desired in the extrudate. In the present invention, extrusion in the form of spaghetti or noodles is particularly preferred. Other shaped forms such as flakes, tablets, pellets, ribbons, threads and the like are suitable alternatives. Special extruders for the foregoing purposes are well known in the art and include for example Elanco models EXD-60; EXDC-100; and EXD-180, a Buhler extruder and the like. Generally, the spaghetti extrudate is a form-retaining mass, i.e. semi-solid and essentially non-tacky at room temperature requiring in most cases no further treatment such as water removal. If necessary, the latter can be effected by simple drying techniques. The spaghetti should have an average length of from about 2 to 20 mm. with about 95% thereof within a tolerance of 0.5 to 20 mm. and an average diameter or width of from about 0.2 to 2.0 mm. with a range of 0.4 to 0.8 mm. being preferred. The bulk density of the spaghetti will usually be from about 0.2 to 0.8 g/cc$^3$. Flakes will measure about 4 mm. in length and breadth and 0.2mm. in thickness, pallets have a cross section of about 2.5 mm. while tablets have a cross section of 2.5 mm. and a thickness of 2.5 mm. Water dispersibility of the shaped extrudate is excellent. In accordance with preferred embodiments, the soap spaghetti as well as cationic softener are dry blended, by post addition, with dried detergent in particulate form such as granules, beeds and the like, the detergent having been prepared as is customary in the art, e.g. spray drying a crutcher mix of surfactant, builder filler, etc. However, it is within the scope of the invention to add part or all of the soap spaghetti to the crutcher mix since this procedure likewise results in the desired dispersion of soap spaghetti as discrete particles.

In any event, it is advisable to maintain physical separation of the soap and cationic softener and thus inclusion of the softener in the soap spaghetti should be avoided. The aforedescribed post-blending expedient usually insures against any appreciable, inadvertent contacting of soap and softener since these are added as separate components to the detergent in dry form. Though the soap spaghetti be added to the crutcher, cationic softener nevertheless is post-added as explained. Although surfactants of conventional type can be used herein, it is preferred that at least about 90% and preferably at least about 95% of the total surfactant or detergent be of the anionic type, these materials being particularly beneficial in heavy duty detergent for fabric washing. Anionics for use herein generally include the water soluble salts of organic reaction products having in their molecular structure an anionic solubilizing group such as $SO_4H$, $SO_3H$, COOH and $PO_4H$ and an alkyl or alkyl group having about 8 to 22 carbons in the alkyl group or moiety. Suitable detergents are anionic detergent salts having alkyl substituents of 8 to 22 carbon atoms such as: water soluble sulfated and sulfonated anionic alkali metal and alkaline earth metal detergent salts containing a hydrophobic higher alkyl moiety, such as salts of higher alkyl mono- or polynuclear aryl sulfonates having from about 8 to 18 carbon atoms in the alkyl group which may have a straight preferred or branched chain structure, preferred species including, without necessary limitation: sodium linear tridecylbenzene sulfonate, sodium linear dodecyl benzene sulfonate sodium linear decyl benzene sulfonate, lithium or potassium pentapropylene benzene sulfonate; alkali metal salts of sulfated condensation products of ethylene oxide, e.g. containing 3 to 20 and preferably 3 to 10 moles of ethylene oxide, with aliphatic alcohols containing 8 to 18 carbon atoms or with alkyl phenols having alkyl groups containing 6 to 18 carbon atoms, e.g. sodium nonyl phenol pentaethoxamer sulfate and sodium lauryl alcohol triethoxamer sulfate; alkali metal salts of saturated alcohols containing from about 8 to 18 carbon atoms, e.g. sodium lauryl sulfate and sodium stearyl sulfate; alkali metal salts of higher fatty acid esters of low molecular weight alkylol sulfonic acid, e.g. fatty acid esters of the sodium salt of isethionic acid; fatty ethanol—amide sulfates; fatty acid amides of amino alkyl sulfonic acids, e.g. lauric acid amide of taurine; alkali metal salts of hydroxy alkane sulfonic acids having 8 to 18 carbon atoms in the alkyl group, e.g., hexadecyl, alphahydroxy sodium sulfonate. The anionic or mixture thereof is used in the form of their alkali or alkaline earth metal salts. The anionic is preferably of the non-soap type, however, minor amounts of soap, e.g. up to about 35% and preferably 20% based on total anionic can be separately added, for example, to the crutcher mix. The concentration of non-soap anionic should be selected so as to provide an excess with respect to cationic-softener according to the emperical relationship $$\% \text{ concentration anionic} \geqq 1.5 + 5$$

wherein x is the percent concentration of cationic softener. This assures the minimum excess of anionic necessary for optimum overall detergency, softening, etc. performance in the product composition.

Minor amounts of other types of detergents can be included along with the anionic, their sum in any case not exceeding about 10% and preferably about 2–5% of total detergent i.e., such other detergent plus non-soap anionic. Useful here are the nonionic surface active agents which contain an organic hydrophobic group and a hydrophilic group which is a reaction product of a solubilizing group such as carboxylate, hydroxyl, amido or amino with ethylene oxide or with the polyhydration product thereof, polyethylene glycol. Included are the condensation products of $C_8$ to $C_{30}$ fatty alcohols such as tridecyl alcohol with 3 to 100 moles ethylene oxide; $C_{16}$ to $C_{18}$ alcohol with 11 to 50 moles ethylene oxide; ethylene oxide adducts with monoesters of polyhydric e.g. hexahydric alcohol; condensation products of polypropylene glycol with 3 to 100 moles ethylene oxide; the condensation products of alkyl ($C_6$ to $C_{20}$ straight or branded chain) phenols with 3 to 100 moles ethylene oxide and the like.

Suitable amphoteric detergents generally include those containing both an anionic group and a cationic group and a hydrophobic organic group which is preferably a higher aliphatic radical of 10 to 20 carbon atoms; examples include the N-long chain alkyl aminocarboxylic acids and the N-long chain alkyl iminodicarboxylic acids such as described in U.S. Pat. No. 3,824,189.

The compositions herein preferably include water soluble alkaline to neutral builder salt in amounts of from about 10 to 60% by weight of total composition. Useful herein are the organic and inorganic builders including the alkali metal and alkaline earth metal phosphates, particularly the condensed phosphates such as the pyrophosphates or tripolyphosphates, silicates, borates, carbonates, bicarbonates and the like. Species thereof include sodium tripolyphosphate, trisodium phosphate, tetrasodium pyrophosphate, sodium acid pyrophosphate, sodium monobasic phosphate, sodium dibasic phosphate, sodium hexametaphosphate; alkali metal silicates such as sodium metasilicate, sodium silicates: $Na_2O/SiO_2$ of 1.6:1 to 3.2:1, sodium carbonate, sodium sulfate, borax (sodium tetraborate) ethylene diamine tetraacetic acid tetrasodium salt, trisodium nitrilotriacetate and the like and mixtures of the foregoing. Builder salt may be selected so as to provide either phosphate-containing or phosphate-free detergents. As to the latter embodiments, sodium carbonate is particularly effective. Another material found to provide good detergency effects is metakaolin which is generally produced by heating kaolinite lattice to drive off water producing a material which is substantially amorphous by x-ray examination but which retains some of the structural order of the kaolinite. Discussions of kaolin and metakaolin are found in U.S. Pat. No. 4,075,280 columns 3 and 4 and Grimshaw, "The Chemistry of Physics of Clays and Allied Ceramic Materials", (4th ed., Wiley-Interscience), pages 723–727. Metakolin is also the subject of U.S. patent applications Ser. Nos. 905,622 now U.S. Pat. No. 4,183,815 and 905,718 now U.S. Pat. No. 4,178,225, the relevant disclosures of which are herein incorporated by reference. The metakaolin also appears to have softening utility. As to the latter, the most effective metakaolins appear to be those which behave best in the reaction with sodium hydroxide to form zeolite 4A as described in U.S. Pat. No. 3,114,603 which refers to such materials as "reactive kaolin". As explained in the referenced sources, metakaolin is an aluminosilicate. The metakaolin and/or a zeolite is included in about the same amounts as the builder salt, and preferably supplemental thereto, e.g. zeolite-silicate in a ratio of 6:1. A particularly useful form of the metakaolin is that available commercially as Satintone No. 2.

Preferred optional ingredients useful herein include perfumes, optical brighteners and bluing agents which may be dyes or pigments, suitable materials in this regard including stilbene and Tinopal 5BM brighteners and particularly in combination and Direct Brilliant Sky Blue 6B, Solophenyl Violet 4BL, Cibacete Brilliant Blue RBL and Cibacete Violet B, Polar Brilliant Blue RAW and Calcocid Blue 2G bluing agents. The brightener may be included in amounts ranging up to about 1% of the total composition while bluing agent may range up to about 0.1% preferably up to about 0.01% of total composition. Bluing agent e.g. Polar Brilliant Blue may be included in the soap spaghetti. In either case, the amount need only be minimal to be effective.

Other ingredients of optimal significance include bleaching agents which may be of the oxygen or chlorine liberating type; oxygen bleaches include sodium and potassium perborate, potassium monopersulfate and the like, while chlorine bleaches are typified by sodium hypochlorite, potassium dichloroisocyanurate, trichloroisocyanuric acid and the like. The latter chlorine-liberating bleaches are representative of the broad class of water soluble, organic, dry solid bleaches known as the N-chloro imides including their alkali metal salts. These cyclic imides have from about 4 to 6 members in the ring and are described in detail in U.S. Pat. No. 3,325,414. Each of the oxygen and chlorine type bleaches discussed above are fully compatible with the compositions herein and have good stability in the presence of the anionic and cationic components. They are generally used in proportions ranging from about 0.1 to 25% by weight of total solids or from about 0.05% to about 20% based on total detergent composition.

Yet additional optional ingredients include water soluble and/or dispersible hydrophobic colloidal cellulosic soil suspensing agent. Methyl cellulose, e.g. Methocel is particularly effective. Polyvinyl alcohol is likewise effective and especially in the washing of cotton and synthetic fibers such as nylon, dacron and resin treated cotton. The additional soil suspending agent may be included in amounts up to about 2% based on total solids and up to about 4% based on total detergent composition.

Fillers may also be included in addition to the aforementioned ingredients, such as sodium sulfate, sodium chloride and the like. The amount will range up to about 40% of total composition.

The detergent composition is prepared by conventional processing such as spray drying a crutcher mix of surfactant, builder, filler, etc. without volatile ingredients such as perfume or ingredients otherwise adversely affected by the spray drying process such as peroxygen bleach, e.g. sodium perborate. Ingredients of this type are preferably post blended. As previously mentioned, the soap spaghetti and cationic amine softener are simply dry blended with the dried detergent in particulate form by simple mechanical mixing which is more than adequate to achieve a homogeneous product. As previously explained, part or all of the soap spaghetti may alternatively be added to the aqueous crutcher mixture.

A typical procedure would be as follows: Water is added to a crutcher followed in order by anionic, sodium silicate, optional ingredients where used such as Satintone #2 and filler such as sodium sulfate and builder salt. The crutcher mixture is heated to about 140° F. before addition of builder, e.g. sodium tripolyphosphate and the solids content of the crutched mixture before spray drying is about 55–65%. Spray drying may be carried out in conventional manner by pumping the hot mixture from the crutcher to a spray tower where the mixture passes through a spray nozzle into a hot evaporative atmosphere. Bleach and other materials remaining to be added are incorporated into the cooled, dried detergent mass by any suitable means such as simple mechanical mixing.

In use, sufficient of the detergent composition is added to the wash cycle to provide a concentration of cationic softener in the wash medium of about 1.5 to 8.0 g/3500 g laundry with a range of 1.8 to 6.0 g being preferred. Washing temperature may range from about 70 to the boil (about 212° F.).

Certain types of aliphatic quaternary ammonium compounds though relatively ineffective as regards softening are nevertheless quite effective as antistats in the compositions herein and particularly since they are physically compatible with anionic surfactant in liquid environments. In general, such materials encompass the ethoxylated and/or propoxylated quaternary ammonium compounds of the following formula:

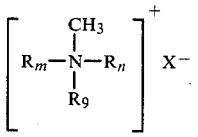

wherein $R_m$ and $R_n$ represent ethoxy or propoxy, m and n are integers of from 1 to 50 and may be the same or different and $R_9$ represents alkyl of 14 to 24 carbon. Compounds of this type include (a) methylbis (2-hydroxy-ethyl) coco ammonium chloride a liquid 75% active ingredient in isopropanol/water solvent and available commercially as Ethoquad ®c/12, Armak and Variquat ®638, Sherex Chemical Co.; (b) Ethoquad c/25-same as in (a) but having 15 moles of ethylene oxide (each of $R_m$ and $R_n$) and available as 95% active ingredient; (c) methylbis (2-hydroxyethyl) octadecyl ammonium chloride, a liquid, 75% active ingredient in isopropanol/water solvent available commercially as Ethoquad 18/12, Armak and (d) same as (c) but having 15 moles of ethylene oxide (each of $R_m$ and $R_n$), a liquid, 95% active ingredient and available commercially as Ethoquad 18/25, Armak. These materials can be used in amounts ranging up to about 10% by weight of total composition.

The following examples are given for purposes of illustration only and are not intended to limit the invention. All parts and percentages are given by weight.

EXAMPLE 1

A spray dried heavy duty detergent having the following composition is provided:

| | % |
|---|---|
| Linear tridecylbenzene sulfonate (LTBS) | 15 |

-continued

| | % |
|---|---|
| tripolyphosphate sodium (NATPP) | 33 |
| silicate | 7 |
| brightener (Stilbene and Tinopal 5 BM) | 0.48 |
| Q.s. sodium sulfate and water | 44.52 |
| | 100.00 |

To 95 g. of the above composition are added:

| | grams |
|---|---|
| distearyl dimethyl ammonium chloride (Arosurf TA-100 Sherex Chemical Co., 93% A I powder | 5 |
| Soap spaghetti (tallow/coco 85/15; blue color Polar Brillant Blue' spaghetti length = 15 mm; and diameter = 0.5 mm | 5 |

to provide a homogeneous composition by simple mechanical mixing.

Washing tests with the foregoing composition are conducted as follows using General Electric washers, 17 gallons tap water at 120° F. (approximately 100 ppm hardness), tests are conducted on a single towel, fabric softness evaluation being taken on a scale of 1 (no softness) to 10 (excellent softness); whiteness (-b) readings are taken on a Gardner Color Difference Meter in the usual manner, about 0.5 unit visually discernible and with higher values indicating increased whiteness. Towels washed as indicated above were evaluated as to softness and whiteness.

EXAMPLE 2

Example 1 is repeated except that the soap spaghetti is provided in the form of flakes having a length of about 4 m.m., a width of about 4 m.m. and a thickness of about 0.2 m.m.

EXAMPLE 3

Example 1 is repeated except that the soap is omitted.

The following softness and whiteness results are obtained.

| Example No. | Softness | −b |
|---|---|---|
| 1 | 10* | 7.7 |
| 2 | 10* | 6.1 |
| 3 | 8 | 6.4 |

The use of the soap in spaghetti form (Example 1) provides excellent softness and more effective detergency than either of Examples 2 or 3. The asterisk superscript to the softness value indicates the highly desirable quality of fluffiness indicative of softness-plus. This same fluffy quality is obtained with the use of soap flakes (Example 2). The absence of the soap in Example 3 leads to a marked reduction in softness as the data demonstrates. It must be pointed out that the slight numerical difference in whiteness favoring Example 3 as compared to Example 2 is of questionable significance even apart from possible experimental error since the 0.3 difference therebetween in whiteness is not within the range of visual discernibility.

EXAMPLES 4 AND 5

Examples 1 and 3 are repeated except that testing is carried out using 2 new towel specimens with ballast loads. Softness and brightness measurements are taken in the manner indicated on each towel.

EXAMPLE 6

The process of Example 1 is repeated but using commercial detergent compositions (A&B) having the following proximate analyses:

| | % | |
|---|---|---|
| | A | B |
| Linear alkyl benzene sulfonate | 7.3 | 11.8 |
| fatty alcohol sulfate & ethoxylated sulfate | 11.5 | 4.0 |
| Dialkyl dimethyl ammonium chloride | 4.7 | 4.5 |
| [1]Bentonite | 18.0 | 21.7 |
| Nonionic | 2.7 | 2.8 |
| Soap | 0.7 | 0.9 |
| TPP | 24 | 24 |

[1]High swelling Wyoming type such as Thiox-jel No. 1.

The above analyses were taken about 3 months apart on products current at that time which probably accounts for the difference in concentrations for each of the ingredients. The commercial formula includes about 5% quat and a relatively small amount of soap, the ratio of quat to soap being at least about 4.5 to 1 on the basis of these approximate data.

Softness and brightness measurements gave the following results:

| | Softness | | −b | |
|---|---|---|---|---|
| Example No. | Towel 1 | Towel 2 | Towel 1 | Towel 2 |
| 4 | 10 | 8 | 6.6 | 7.4 |
| 5 | 6 | 6 | 6.5 | 6.3 |
| 6A | 8 | 5 | 6.5 | 6.6 |

The soap spaghetti composition (Example 4) is superior in both softness and detergency compared to the soapless embodiment (Example 5 Arosurf only) and the commercial formula (Example 6) whether the results be considered singly or on an average basis. The commercial composition though marginally superior to the soapless composition does not produce visually discernible increase in detergency (whiteness) when compared to that composition. On an average basis, the soap spaghetti composition provides a visually discernible increase in whiteness when compared to either of Examples 5 and 6.

EXAMPLE 7

Example 1 is repeated as follows:

(a) same as Example 1

(b) the NATPP of Example 1 is replaced with the same amount of sodium carbonate

In each case, testing is carried out on 2 towel specimens:

The result are as follows:

| | Softness | | −b |
|---|---|---|---|
| | Towel 1 | Towel 2 | Average - 2 towels |
| (a) | 10 | 10 | 5.8 |
| (b) | 10+ | 10+ | 4.6 |

Superior softness is obtained for the non-phosphate run (b); however, the phosphate run (a) yields superior whiteness. Nevertheless, run (b) is superior in both softness and detergency when compared to a control run, the same as run (b) but omitting the soap. The foregoing is understandable since the phosphate builders are recognized as having exceptional detersive activity as compared to other builder salts. The use of zeolite in the composition has the effect of increasing detergency as the following example demonstrates.

EXAMPLE 8

Example (7b) is repeated but replacing the sodium carbonate with zeolite. The results are as follows:

| | Softness | | −b |
|---|---|---|---|
| Example | Towel 1 | Towel 2 | Average for 2 towels |
| 8 | 10 | 10 | 5.2 |
| 7(b) | 10+ | 10+ | 4.6 |

The use of zeolite provides a visually discernible increase in whiteness; however, at the expense of the fluffy quality of Example 7(b); nevertheless, the softness rating of 10 is excellent.

EXAMPLE 9

The effects of decreasing the concentration of both the soap spaghetti and softener components in the sodium carbonate built composition of Example 7(b) but maintaining a unity weight ratio therebetween is observed from the following test runs:

| | | % |
|---|---|---|
| (a) | detergent composition of Example 7(b) | 92 |
| | Arosurf TA-100 | 4 |
| | soap spaghetti | 4 |
| (b) | detergent composition of Example 7(b) | 94 |
| | Arosurf TA-100 | 3 |
| | soap spaghetti | 3 |

Softness and brightness results are as follows:

| | Softness | | −b |
|---|---|---|---|
| | Towel 1 | towel 2 | average 2 towels |
| (a) | 10 | 10 | 5.8 |
| (b) | 10 | 10 | 6.2 |

Softness is the same for (a) and (b). The non-visually discernible increase in detergency for run (b) probably results from the presence of more detergent. It seems clear then that increasing the amount of cationic relative to anionic does not affect detergency at least insofar as the human eye is concerned. It is possible if not probable that by decreasing the proportion of anionic in run (b) to the value of run (a) the brightness values would be about equal.

EXAMPLE 10

The effects of decreasing the concentration of both the soap spaghetti and softener components in the zeolite built composition of Example 8 but maintaining a unity weight ratio therebetween is observed from the following test runs:

| | | % |
|---|---|---|
| (a) | detergent composition of Example 8 | 92 |
| | Arosurf TA-100 | 4 |
| | soap spaghetti | 4 |
| (b) | detergent composition of Example 8 | 94 |
| | Arosurf TA-100 | 3 |
| | soap spaghetti | 3 |

Softness and brightness results are as follows:

| | Softness | | −b |
|---|---|---|---|
| | towel 1 | towel 2 | average - 2 towels |
| (a) | 9 | 9 | 5.8 |
| (b) | 10 | 10 | 6.2 |

The difference in whiteness is explained by the discussion in connection with example 9. The decrease in softness is probably accounted for by the fact that the effects of zeolite on softness seem to be somewhat inconsistent. The softness rating of 9 in run (b) is nevertheless indicative of good softness.

EXAMPLE 11

Example 1 is repeated except that the amounts soap and Arosurf TA-100 are 6% and 4% respectively. Softness ratings (2 towels) are 10+ and 10+, the average -b being 6.7. This is markedly superior to a control run omitting the soap spaghetti as to both softness and brightness.

Embodiments of the present invention compare distinctly favorably with control runs wherein the cationic softener is omitted as the foregoing examples make clear. Interestingly, when the cationic softener is omitted, the detergency of the resultant composition as determined by -b measurements are often inferior to the soap, cationic softener embodiments in accordance with the invention. In most cases, any difference in -b is not such as to be visually discernible. Softness ratings, omitting the cationic softener are poor being in the order of scale 1.0. The test data thus cogently demonstrates the fact that the use of the soap system and cationic in accordance with the invention provides excellent softness and in many cases fluffiness with no evidence of detrimental effects on detergency. Of further significance is the complete absence of adverse effects upon the softening capacity of the cationic despite the presence of the soap. As explained previously herein, it would normally be thought that the soap might detract from the softening efficacy of the cationic. In the present invention, quite the converse is the case as the prior examples demonstrate. It appears that the soap spaghetti significantly enhances the softening activity of the cationic.

Examples 12–14 which follow are illustrative of compositions found to be particularly effective in accordance with the invention.

EXAMPLES 12–14

The following heavy duty compositions are prepared:

| | Example No. | | |
|---|---|---|---|
| | 12 % | 13 % | 14 % |
| linear tridecyl benzene sulfonate | 15 | — | — |
| linear dodecyl benzene sulfonate | — | 23 | 19 |
| LATPP | 33 | — | — |
| $Na_2CO_3$ | — | 20 | — |
| Silicate | 7 | 15 | 5 |
| Borax | 1 | 3 | — |
| Zeolite | — | — | 30 |
| Nonionic | — | 1 | 1 |
| Soap | — | 2 | — |
| CMC | — | 1 | — |
| [1]brightener | .48 | .48 | .48 |
| satintone | — | 1 | — |
| Genie perfume | .15 | — | — |
| $Na_2SO_4$ & $H_2O$ | q.s | q.s | q.s |

[1]Stilbene and Tinopal 5BM

To 90 grams of each of the foregoing compositions are added 5 grams of soap spaghetti and 5 grams of Arosurf TA-100 as described in Example 1. Softness and brightness measurements are taken on washed towl specimens as described in Example 1. The results obtained compare favorably with those of Example 1, i.e., excellent softness and detergency results obtain.

EXAMPLES 15–18

Example 1 is repeated but replacing the cationic softener with the following:

| Example No. | Softener |
|---|---|
| 15 | dihydrogenated tallow dimethyl ammonium chloride |
| 16 | ditallow dimethyl ammonium chloride |
| 17 | distearyl dimethyl ammonium methyl sulfate |
| 18 | di-hydrogenated tallow dimethyl ammonium methyl sulfate |

Softness and whiteness results are similar to those of Example 1.

EXAMPLES 19 & 20

Example 1 is repeated but replacing the cationic softener with the following imidazolinium compounds.

| Example No. | Softener |
|---|---|
| 19 | methyl-1-tallow amido ethyl-2-tallow imidazolinium methyl sulfate |
| 20 | methyl-1-oleyl amido ethyl-2-oleyl imidazolinium methyl sulfate |

Softness and whiteness results are similar to those of Example 1.

The addition of bleach e.g. perborate, to the present composition within the concentration limits hereinbefore given can be made without significant adverse effects on either detergency or softness. Thus, no visually discernible reduction in detergency is noted. As to softness, about the only untoward effect noted in a slight reduction in the fluffy quality of the fabric indicated by a reduction in the softness rating of from 10+ to 10 in several test runs.

When Example 1 is repeated but adding from 0.5% to 2% of the ethoxylated quat materials described hereinbefore, e.g. methylbis (2-hydroxyethyl) coco ammonium chloride, further enhancement of the antistat capability of the present compositions obtain. Softness and detergency are not adversely affected, test runs establishing the ethoxylated quats to be fully compatible in the present compositions and particularly as regards the anionic surfactant.

Results similar to those described in the foregoing examples are obtained when their procedures are repeated but replacing, for example, the fatty acid soap with the equivalent materials enumerated hereinbefore. Within the limits given, the fatty acid can be varied widely, e.g., soaps of myristic, capric and lineolic acids and their mixtures with essentially the same results.

The concentration of cationic softener and soap spaghetti in the composition can be increased up to about 20% with good softening and whitening results provided anionic concentration and, of course, the softener/soap spaghetti ratio be limited as heretobefore explained. As the concentration is thus increased, it may be adivsable to maintain softener/soap spaghetti ratios to values epproximating unity, this being a preferred embodiment. Softener and soap spaghetti are compatible with anionic at these increased concentration. The highly concentrated form of the composition is advantageous from several standpoints having reference to, for example, unusually severe laundering problems allowing the dispensing of smaller yet more potent amounts by the user.

A further illustrative example is as follows:

EXAMPLE 21

A composition of the following is crutched in the conventional manner and spray dried.

| | % |
|---|---|
| tridecyl benzene sulfonate | 15.0 |
| TPP | 33.0 |
| Sodium silicate (1:2.4 $Na_2O:SiO_2$) | 7.0 |
| Sodium Carbonate | 5.0 |
| Borax | 1.0 |
| CMC | 0.25 |
| Dow Methocel XD8861 | 0.56 |
| Stilbene brightener | 0.4 |
| Tinopal 5BM | 0.08 |
| Water | 11.00 |
| | 100.00 |

To 89.403 g of the above spray dried composition there are added

| | |
|---|---|
| Arosurf TA-100 | 5.0 g |
| Soap spaghetti (Ex. 1) | 5.0 g |
| Non-ionic ($C_{12-15}$ linear aliphatic alcohol + 7 E.O.) | 0.47 g |
| Perfume | 0.15 g |

to give 100 g of product. The performance of the above is similar to Example 1.

In the foregoing examples, the particulate soap may be replaced by soap compositions containing any additional ingredients which are desired in the detergent. Thus minor (less than about 50%, e.g., 0.1 to 49.99%) of brighteners, antiredeposition agents (CMC hydroxy butyl methyl cellulose, etc.) bleaches, anti-oxidants foam suppressors, perfumes, fillers, etc. may be mixed with the soap prior to particulating the soap. In many instances the foregoing additives as well as other apparent to one skilled in the art (e.g. NaCl, etc.,) will function to aid in solubilizing the soap in the laundry bath.

What is claimed is:

1. A detergent softener composition capable of imparting improved softness, detergency antistatic and soil antiredeposition properties to fabrics treated therewith in the wash cycle of a laundering process comprising, (a) spray-dried detergent particles comprising in percents relative to the weight of the composition, from about 5 to 40% of water soluble nonsoap organic surfactant at least about 90% thereof being an anionic surfactant, from about 1.6 to 7% soap dispersed throughout the particles, and from about 10 to 60% of water soluble neutral to alkaline builder salt;

(b) about 2 to 20% by weight relative to the weight of the composition, of discrete particles of soap; and (c) about 2 to 20% by weight relative to the weight of the composition, of discrete particles of cationic amine softener, wherein said discrete soap particles do not contain cationic softener and said cationic softener particles do not contain soap, wherein said discrete particles are in admixture with said spray-dried detergent particles and said spray-dried detergent particles do not include cationic amine softener, and wherein said soap is a water soluble or dispersible fatty acid soap, and said cationic softener is a cationic amine softener selected from the group consisting of (1) aliphatic di-(lower)$C_1$–$C_4$ alkyl, di(higher)$C_{14}$–$C_{24}$ alkyl quaternary ammonium salts (2) heterocyclic imide compounds, and mixtures of (1) and (2), the weight ratio of soap to softener being from about 8:1 to 1:3 and the percent concentration of anionic surfactant being at least about $1.5x+5$, wherein x represents the percent concentration of softener.

2. A composition according to claim 1 wherein said soap comprises an alkali metal $C_{10}$–$C_{30}$ fatty acid, at least about 50% thereof being $C_{10}$–$C_{18}$ fatty acid.

3. A composition according to claim 2 wherein said soap is a mixture of coconut oil and tallow fatty acid salts.

4. A composition according to claim 3 wherein said soap is an 85/15 tallow/coco mixture.

5. A composition according to claim 1 wherein said softener is distearyl dimethyl ammonium chloride.

6. A composition according to claim 1 wherein said softener is di-hydrogenated tallow dimethyl ammonium chloride.

7. A composition according to claim 1 wherein said softener is methyl-1-tallow amido ethyl-2-tallowimidazolinium methyl sulfate.

8. A composition according to claim 1 wherein said softener is methyl-1-oleyl amido ethyl-2-oleylimidazolinium methyl sulfate.

9. A composition according to claim 1 wherein the ratio of soap to softener is about 1:1.

10. A composition according to claim 1 wherein said builder salt is an alkali metal phosphate and/or polyphosphate.

11. A composition according to claim 10 wherein said builder salt is sodium tripolyphosphate.

12. A composition according to claim 1 wherein said anionic detergent is linear tridecylbenzene sulfonate.

13. A composition according to claim 1 wherein said anionic detergent is linear dodecyl benzene sulfonate.

14. A composition according to claim 1 comprising from about 5 to 45% of metakaolin as the builder salt.

15. A composition according to claim 1 comprising from about 5 to 45% of zeolite as the builder salt.

16. A composition according to claim 1 further comprising up to about 25% of water soluble fabric bleaching agent.

17. A composition according to claim 16 wherein said bleaching agent is alkali metal perborate.

18. A composition according to claim 1 wherein the concentration of each of the softener and soap is at least about 4%.

19. A detergent softener according to claim 1 wherein said heterocyclic imide compound is an imidazolinium cationic softener.

20. A detergent softener according to claim 1 further comprising nonionic detergent in admixture with said spray-dried detergent particles.

21. A detergent softener composition according to claim 1 comprising in weight percentages relative to the total weight of the composition from about 3 to about 5% of the cationic softener selected from the group consisting of distearyl dimethyl ammonium chloride, di-hydrogenated tallow dimethyl ammonium chloride, di-tallow dimethyl ammonium chloride, distearyl dimethyl ammonium methyl sulfate, di-hydrogenated tallow dimethyl ammonium methyl sulfate, methyl-1-tallow amido ethyl-2-tallow imidazolinium methyl sulfate, and methyl-1-oleyl amido ethyl-2-oleyl imidazolinium methyl sulfate; the soap selected from the group consisting of an alkali metal salt of a $C_{10}$ to $C_{30}$ fatty acid at least about 50% thereof being $C_{10}$ to $C_{18}$ fatty acid; the spray-dried detergent particles comprising from about 10 to 60% of detergent builder particles selected from the group consisting of alkali metal phosphate, sodium carbonate, metakaolin and zeolite detergent builders, about 3 to 4.6% soap dispersed throughout the particles, and from about 15 to 23% of the nonsoap anionic surfactant.

22. The composition according to claim 21 wherein said softener compound is distearyl dimethyl ammonium chloride, said soap is a soap spaghetti particle comprising a mixture of coconut oil and tallow fatty acid salts, said builder is sodium tripolyphosphate; and said non-soap anionic surfactant is selected from the group consisting of linear tridecyl benzene sulfonate and linear dodecyl benzene sulfonate.

23. A process for washing fabrics comprising contacting said fabrics in an aqueous medium at a temperature of from about 80° to 170° F. with sufficient of the composition of claim 1 to provide a ratio of from 1.5 to 8.0 g of softener per 3500 g of fabric.

* * * * *